US010808195B2

(12) United States Patent
Abdul-Manan et al.

(10) Patent No.: US 10,808,195 B2
(45) Date of Patent: Oct. 20, 2020

(54) FUEL COMPOSITIONS

(71) Applicant: SHELL OIL COMPANY, Houston, TX (US)

(72) Inventors: Amir Faizal Naidu Abdul-Manan, Kuala Lumpur (MY); Paul Anthony Stevenson, Manchester (GB); Richard John Heins, Manchester (GB); Richard Hugh Clark, Manchester (GB); Robert Wilfred Matthews Wardle, Manchester (GB)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/761,539

(22) PCT Filed: Sep. 20, 2016

(86) PCT No.: PCT/EP2016/072328
§ 371 (c)(1),
(2) Date: Mar. 20, 2018

(87) PCT Pub. No.: WO2017/050777
PCT Pub. Date: Mar. 30, 2017

(65) Prior Publication Data

US 2018/0346837 A1 Dec. 6, 2018

(30) Foreign Application Priority Data

Sep. 22, 2015 (EP) ..... 15186180

(51) Int. Cl.

| | |
|---|---|
| ***C10L 10/10*** | (2006.01) |
| ***C10L 1/06*** | (2006.01) |
| ***C10G 2/00*** | (2006.01) |
| ***C10L 1/183*** | (2006.01) |
| ***C10L 1/223*** | (2006.01) |

(52) U.S. Cl.
CPC ..... *C10L 10/10* (2013.01); *C10G 2/00* (2013.01); *C10L 1/06* (2013.01); *C10L 1/1832* (2013.01); *C10L 1/223* (2013.01); *C10G 2300/1022* (2013.01); *C10G 2300/305* (2013.01); *C10G 2300/80* (2013.01); *C10G 2400/02* (2013.01); *C10L 2200/0259* (2013.01); *C10L 2200/0423* (2013.01); *C10L 2200/0492* (2013.01); *C10L 2270/023* (2013.01); *C10L 2270/026* (2013.01)

(58) Field of Classification Search
CPC .... C10L 1/04; C10L 10/10; C10L 1/06; C10L 1/1832; C10L 1/223; C10L 2200/0259; C10L 2200/0423; C10L 2200/0492; C10L 2270/023; C10L 2270/026; C10G 2300/1022; C10G 2300/305; C10G 2300/80; C10G 2400/02; C10G 2/00
See application file for complete search history.

(56) References Cited

U.S. PATENT DOCUMENTS

| | | | | |
|---|---|---|---|---|
| 4,125,566 | A | 11/1978 | Trin Dinh et al. | |
| 4,478,955 | A | 10/1984 | Pesa et al. | |
| 4,849,572 | A | 7/1989 | Chen et al. | |
| 4,877,416 | A | 10/1989 | Campbell | |
| 4,943,672 | A | 7/1990 | Hamner et al. | |
| 5,059,299 | A | 10/1991 | Cody et al. | |
| 5,855,629 | A | 1/1999 | Grundy et al. | |
| 6,204,426 | B1 | 3/2001 | Miller et al. | |
| 8,518,130 | B2 | 8/2013 | Croft et al. | |
| 8,557,001 | B2 | 10/2013 | Brewer et al. | |
| 2003/0141222 | A1 | 7/2003 | O'Rear et al. | |
| 2009/0193711 | A1* | 8/2009 | Clark | C10L 1/023 44/451 |
| 2010/0258071 | A1* | 10/2010 | Paggi | C10L 1/14 123/1 A |
| 2015/0166920 | A1* | 6/2015 | Brewer | C10L 1/14 44/384 |
| 2015/0184095 | A1 | 7/2015 | Landschof | |

FOREIGN PATENT DOCUMENTS

| | | | |
|---|---|---|---|
| DE | 3826608 | A1 | 2/1990 |
| DE | 3838918 | A1 | 5/1990 |
| DE | 4142241 | A1 | 6/1993 |
| DE | 4309074 | A1 | 9/1994 |
| DE | 19620262 | A1 | 11/1997 |
| DE | 10102913 | A1 | 7/2002 |
| EP | 0147873 | A1 | 7/1985 |
| EP | 0310875 | A1 | 4/1989 |

(Continued)

OTHER PUBLICATIONS

Van Der Burgt et al., "The Shell Middle Distillate Synthesis Process", 5th Synfuels Worldwide Symposium, Washington, D.C., Nov. 11-13, 1985, 15 pages.
Sagarin et al., Cosmetics Science and Technology, Chapter VIII, 1972, pp. 189 et. seq.
International Search Report and Written Opinion received for PCT Patent Application No. PCT/EP2016/072328, dated Nov. 18, 2016, 13 pages.

*Primary Examiner* — Latosha Hines

(57) ABSTRACT

Gasoline fuel composition suitable for use in an internal combustion engine comprising: (a) Fischer-Tropsch derived naphtha at a level from 2 to 20% v/v; (b) at least one aromatic octane booster present at a level of 0.75 to 8% v/v or less; and (c) a gasoline base fuel; wherein the gasoline fuel composition comprises 40% v/v or less of aromatics. In a preferred embodiment, the Research Octane Number (RON) of the gasoline fuel composition is increased while maintaining the aromatic content of the gasoline fuel composition at a level of 40% v/v or less, based on the gasoline fuel composition.

10 Claims, No Drawings

(56) References Cited

FOREIGN PATENT DOCUMENTS

| | | | |
|---|---|---|---|
| EP | 0356725 | A1 | 3/1990 |
| EP | 0452328 | A1 | 10/1991 |
| EP | 0548617 | A2 | 6/1993 |
| EP | 0583836 | A1 | 2/1994 |
| EP | 0668342 | A1 | 8/1995 |
| EP | 0700985 | A1 | 3/1996 |
| EP | 0776959 | A2 | 6/1997 |
| EP | 0831141 | A1 | 3/1998 |
| EP | 1101813 | A1 | 5/2001 |
| EP | 2435541 | A1 | 4/2012 |
| EP | 2519615 | A2 | 11/2012 |
| EP | 2949733 | A1 | 12/2015 |
| GB | 2077289 | A | 12/1981 |
| JP | 2013001841 | A | 1/2013 |
| WO | 9424231 | A1 | 10/1994 |
| WO | 9703946 | A1 | 2/1997 |
| WO | 9714768 | A1 | 4/1997 |
| WO | 9714769 | A1 | 4/1997 |
| WO | 9920720 | A1 | 4/1999 |
| WO | 9934917 | A1 | 7/1999 |
| WO | 0011116 | A1 | 3/2000 |
| WO | 0011117 | A1 | 3/2000 |
| WO | 0020534 | A1 | 4/2000 |
| WO | 0020535 | A1 | 4/2000 |
| WO | 0183406 | A2 | 11/2001 |
| WO | 0183641 | A2 | 11/2001 |
| WO | 0183647 | A2 | 11/2001 |
| WO | 0183648 | A2 | 11/2001 |
| WO | 03076554 | A1 | 9/2003 |
| WO | 2009050287 | A1 | 4/2009 |
| WO | 2009077606 | A2 | 6/2009 |
| WO | 2010000761 | A1 | 1/2010 |
| WO | 2010028206 | A1 | 3/2010 |
| WO | 2014096250 | A1 | 6/2014 |
| WO | 2015059206 | A1 | 4/2015 |

* cited by examiner

FUEL COMPOSITIONS

PRIORITY CLAIM

The present application is the National Stage (§ 371) of International Application No. PCT/EP2016/072328, filed 20 Sep. 2016, which claims priority from European Application No. 15186180.4, filed 22 Sep. 2015 incorporated herein by reference.

FIELD OF THE INVENTION

The present invention relates to a liquid fuel composition, in particular to a liquid fuel composition having improved octane number.

BACKGROUND OF THE INVENTION

Octane number is a standard measure of the performance of an engine or aviation fuel. The higher the octane number, the more compression the fuel can withstand before igniting. Fuels with a higher octane number are used in high performance gasoline engines that require higher compression ratios. In contrast, fuels with lower octane numbers (but higher cetane numbers) are ideal for diesel engines, because diesel engines (also referred to as compression-ignition engines) do not compress the fuel but rather compress only air and then inject the fuel into the air heated up by compression. Gasoline engines rely on ignition of air and fuel compressed together as a mixture without ignition, which is then ignited at the end of the compression stroke using spark plugs. Therefore, high compressibility of the fuel matters mainly for gasoline engines. Use of gasoline with lower octane numbers may lead to the problem of engine knocking.

The most common type of octane rating is the Research Octane Number (RON). RON is determined by running the fuel in a test engine with a variable compression ratio under controlled conditions, and comparing the results with those for mixtures of iso-octane and n-heptane.

Aromatic octane boosters such as N-Methyl Aniline (NMA) can be added to gasoline to increase octane. However gasoline specifications can include limits on the maximum aromatics content and adding NMA to gasoline increases aromatic content. For example, the EN 228 specification limits aromatics content to a maximum of 35.0% v/v. If the gasoline has an aromatics content that is at or near to the maximum limit, this can restrict the amount of aromatic octane boosters that can be added and can prevent use of aromatic octane boosters such as NMA to obtain target octane levels.

GTL naphtha is a low-value by-product of the low temperature Fischer-Tropsch process that is used to produce distillate fuels from natural gas. GTL naphtha has a low octane rating that makes it generally unsuitable for use in the gasoline pool. Surprisingly it has been found by the present inventors that by combining GTL Naphtha with an aromatic octane booster such as NMA, there is provided a means to increase the octane number of gasoline but without increasing its aromatics content.

SUMMARY OF THE INVENTION

According to the present invention there is provided a gasoline fuel composition suitable for use in an internal combustion engine comprising:

(a) Fischer-Tropsch derived naphtha at a level from 2 to 20% v/v;

(b) at least one aromatic octane booster present at a level of 0.75 to 8% v/v; and (c) a gasoline base fuel;

wherein the gasoline fuel composition comprises 40% v/v or less of aromatics.

According to another aspect of the present invention there is provided the use of Fischer-Tropsch derived naphtha for increasing the Research Octane Number (RON) of a gasoline fuel composition comprising an aromatic octane booster, while maintaining the overall aromatics content of the gasoline fuel composition at a level of 40% v/v or less.

According to yet another aspect of the present invention there is provided a method for increasing the Research Octane Number (RON) of a gasoline fuel composition in an internal combustion engine, while maintaining the overall aromatics content of gasoline fuel composition at a level of 40% v/v or less, said method comprising fuelling the internal combustion engine with a gasoline fuel composition according to the present invention.

DETAILED DESCRIPTION OF THE INVENTION

In order to assist with the understanding of the invention several terms are defined herein.

The term "Research Octane Number" (RON) as used herein is determined by running the fuel in a test engine with a variable compression ratio under controlled conditions, and comparing the results with those for mixtures of iso-octane and n-heptane. RON can be measured in accordance with EN ISO 5164.

The term "aromatic octane booster" as used herein is an aromatic compound which raises the overall octane rating of the gasoline fuel composition. Octane boosters are also known in the art as "anti-knock agents".

According to the present invention, there is provided a method for increasing the Research Octane Number (RON) of a gasoline fuel composition in an internal combustion engine, while maintaining the overall aromatics content of gasoline fuel composition at a level of 40% v/v or less, preferably at a level of 35% v/v or less, said method comprising fuelling the internal combustion engine with a gasoline fuel composition described hereinbelow.

In the context of this aspect of the invention, the term "increasing" embraces any degree of increase. The increase in RON of the gasoline fuel composition may be for instance 1 unit of greater, preferably 5 units or greater, more preferably 8 units or greater, compared to the RON of the gasoline base fuel. The increase in Research Octane Number (RON) of the gasoline fuel composition may be at most 10 units, compared to the RON of the gasoline base fuel.

In accordance with the present invention, the increase in RON provided by a fuel composition may be determined in any known manner, such as EN ISO 5164.

The term "aromatics content" as used herein refers to the total amount of aromatic compounds which are present in the gasoline fuel composition.

The gasoline fuel compositions, methods and uses of the present invention, provide an increase in RON while maintaining the aromatics content of the gasoline fuel composition at or below the level required by the relevant gasoline specification, e.g. the European EN228 specification which requires the level of aromatics to be 35% v/v or less, as measured by EN15553 and EN ISO 22854.

According to a preferred embodiment of the present invention the aromatics content of the gasoline fuel composition is maintained at a level of 34% v/v or less, preferably in the range from 32% v/v to 34% v/v, based on the gasoline fuel composition. In one embodiment, the aromatics content of the gasoline fuel composition is in the range from 32% v/v to 33% v/v, based on the gasoline fuel composition. In another embodiment, the aromatics content of the gasoline fuel composition is in the range from 33% v/v to 34% v/v, based on the gasoline fuel composition.

In accordance with the present invention, the aromatics content of a fuel composition may be determined in any known manner, for instance EN ISO 22854.

The liquid fuel composition of the present invention comprises a gasoline base fuel suitable for use in an internal combustion engine together with a Fischer-Tropsch derived naphtha and an aromatic octane booster. Therefore the liquid fuel composition of the present invention is a gasoline composition.

The aromatic octane boosters used in the gasoline composition of the present invention are not particularly limited. Any aromatic compound which is suitable for use in a gasoline fuel composition and which can raise the octane rating of the gasoline fuel composition may be used herein.

In a preferred embodiment, the aromatic octane booster is selected from aromatic amines and phenols, and mixtures thereof.

Preferred aromatic amine compounds for use herein include primary and secondary aromatic amines. In a preferred embodiment, aromatic amines for use herein are selected from aniline, 2-methylaniline (o-toluidine), 2,4,6-trimethylaniline, 2-methoxyaniline (anisidine), N-methyl aniline (NMA), diphenylamine, dihydroindole, and the like, and mixtures thereof.

Suitable phenols for use herein include phenol and substituted phenols, and mixtures thereof. Examples of substituted phenols include 2-methyl phenol, 3-methyl phenol and 4-methyl phenol.

A preferred aromatic octane booster for use in the gasoline composition herein is an aromatic amine, especially N-methyl aniline (NMA).

The total level of the aromatic octane booster is preferably in the range from 0.75% v/v to 8% v/v, more preferably in the range from 1% v/v to 6% v/v, even more preferably in the range from 1 to 4, and especially in the range of 1.5 to 3.8, based on the total gasoline fuel composition.

The aromatic octane booster may be blended together with any other additives e.g. additive performance package(s) and/or other additive components, to produce an additive blend. The additive blend is then added to a base fuel to produce a liquid fuel composition.

The amount of performance package(s), when present, in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

Another essential component of the fuel compositions herein is Fischer-Tropsch derived naphtha.

The Fischer-Tropsch derived naphtha is preferably present at a level of from 2% v/v to 20% v/v, more preferably from 3.5% v/v to 10.5% v/v, even more preferably from 4% v/v to 10% v/v, based on the gasoline fuel composition.

The person skilled in the art would know what is meant by the term "naphtha". Typically, the term "naphtha" means a mixture of hydrocarbons generally having between 5 and 12 carbon atoms and having a boiling point in the range of 30 to 200° C. Naphtha may be petroleum-derived naphtha or Fischer-Tropsch derived naphtha. The liquid fuel compositions herein comprise a naphtha which is derived from the product of a Fischer-Tropsch synthesis process (a "Fischer-Tropsch derived naphtha").

By "Fischer-Tropsch derived" is meant that the naphtha is, or is derived from, a product of a Fischer-Tropsch synthesis process (or Fischer-Tropsch condensation process). A Fischer-Tropsch derived naphtha may also be referred to as a GTL (Gas-to-Liquid) naphtha.

The Fischer-Tropsch reaction converts carbon monoxide and hydrogen (synthesis gas) into longer chain, usually paraffinic, hydrocarbons:

$$n(CO+2H_2)=(-CH_2-)n+nH_2O+\text{heat},$$

in the presence of an appropriate catalyst and typically at elevated temperatures (e.g., 125 to 300° C., preferably 175 to 250° C.) and/or pressures (e.g., 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. The gases which are converted into synthesis gas, which are then converted into liquid fuel components using Fischer-Tropsch synthesis can in general include natural gas (methane), Liquid petroleum gas (LPG) (e.g., propane or butane), "condensates" such as ethane, and gaseous products derived from coal, biomass and other hydrocarbons.

The Fischer-Tropsch derived naphtha may be obtained directly from the Fischer-Tropsch reaction, or derived indirectly from the Fischer-Tropsch reaction, for instance by fractionation of Fischer-Tropsch synthesis products and/or by hydrotreatment of Fischer-Tropsch synthesis products. Hydrotreatment can involve hydrocracking to adjust the boiling range (see, e.g., GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described by van der Burgt et al. in "The Shell Middle Distillate Synthesis Process", paper delivered at the 5th Synfuels Worldwide Symposium, Washington D.C., November 1985 (see also the November 1989 publication of the same title from Shell International Petroleum Company Ltd, London, UK). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce the desired product, for example Fischer-Tropsch derived naphtha or liquid transport fuels such as the gas oils useable in diesel fuel compositions. A version of the SMDS process, utilising a fixed bed reactor for the catalytic conversion step, is currently in use in Bintulu, Malaysia and its gas oil products have been blended with petroleum derived gas oils in commercially available automotive fuels.

Examples of other Fischer-Tropsch synthesis processes include the so-called commercial Slurry Phase Distillate technology of Sasol and the "AGC-21" ExxonMobil process. These and other processes are, for example, described in more detail in EP-A-776 959, EP-A-668 342, U.S. Pat. Nos. 4,943,672, 5,059,299, WO-A-99/34917 and WO-A-99/20720.

Fischer-Tropsch derived naphtha prepared by the SMDS process is commercially available for instance from the Royal Dutch/Shell Group of companies. Further examples of Fischer-Tropsch derived products are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived naphtha has essentially no, or undetectable levels of, sulphur and nitrogen. Compounds containing these heteroatoms tend to act as poisons for Fischer-Tropsch catalysts and are therefore removed from the synthesis gas feed.

Further, the Fischer-Tropsch process as usually operated produces no or virtually no aromatic components. The aromatics content of a Fischer-Tropsch derived naphtha, suitably determined by ASTM D4629, will typically be below 1% w/w, preferably below 0.5% w/w and more preferably below 0.2 or 0.1% w/w.

Generally speaking, Fischer-Tropsch derived naphthas have relatively low levels of polar components, in particular polar surfactants, for instance compared to petroleum derived naphthas. Such polar components may include for example oxygenates, and sulphur- and nitrogen-containing compounds. A low level of sulphur in a Fischer-Tropsch derived naphtha is generally indicative of low levels of both oxygenates and nitrogen containing compounds, since all are removed by the same treatment processes.

The Fischer-Tropsch derived naphtha component of the present invention is a liquid hydrocarbon distillate with a final boiling point of typically up to 220° C., preferably up to 180° C. or 175° C. Its initial boiling point is typically at least 25° C., preferably at least 30° C.

The Fischer-Tropsch derived naphtha, or the majority of the Fischer-Tropsch derived naphtha (for example, at least 95% w/w), is typically comprised of hydrocarbons having 5 or more carbon atoms.

Suitably, the Fischer-Tropsch derived naphtha component of the present invention will consist of at least 70% w/w, preferably at least 80% w/w, more preferably at least 90 or 95 or 98% w/w, most preferably at least 99 or 99.5 or even 99.8% w/w, of paraffinic components. By the term "paraffinic", it is meant a branched or non-branched alkane (herein also referred to as iso-paraffins and normal paraffins) or a cycloalkane. Preferably the paraffinic components are iso- and normal paraffins.

The amount of normal paraffins in the Fischer-Tropsch derived naphtha is up to 100% w/w. Preferably, the Fischer-Tropsch derived naphtha contains from 20 to 98% w/w or greater of normal paraffins.

The weight ratio of iso-paraffins to normal paraffins may suitably be greater than 0.1 and may be up to 12; suitably it is from 2 to 6. The actual value for this ratio may be determined, in part, by the hydroconversion process used to prepare the gas oil from the Fischer-Tropsch synthesis product.

The olefin content of the Fischer-Tropsch derived naphtha component of the present invention is preferably 2.0% w/w or lower, more preferably 1.0% w/w or lower, and even more preferably 0.5% w/w or lower. The aromatic content of the Fischer-Tropsch derived naphtha component of the present invention is preferably 2.0% w/w or lower, more preferably 1.0% w/w or lower, and even more preferably 0.5% w/w or lower.

The Fischer-Tropsch derived naphtha component of the present invention preferably has a density of from 0.67 to 0.73 g/cm$^3$ at 15° C. and a sulphur content of 5 mg/kg or less, preferably 2 mg/kg or less.

It will be appreciated by the skilled person that Fischer-Tropsch derived naphtha will have a very low anti-knock index. Typically, the Research Octane Number (RON), as measured by ASTM D2699, and the Motor Octane Number (MON), as measured by ASTM D2700, of the Fischer-Tropsch derived naphtha component of the present invention will, independently, be at most 60, more typically at most 50, and commonly at most 40.

Preferably, the Fischer-Tropsch derived naphtha component of the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably, it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Suitably, the Fischer-Tropsch derived naphtha component of the present invention is a product prepared by a low temperature Fischer-Tropsch process, by which is meant a process operated at a temperature of 250° C. or lower, such as from 125 to 250° C. or from 175 to 250° C., as opposed to a high temperature Fischer-Tropsch process which might typically be operated at a temperature of from 300 to 350° C.

In the liquid fuel composition herein, the Fischer-Tropsch derived naphtha component of the present invention may include a mixture of two or more Fischer-Tropsch derived naphthas.

It will be appreciated by a person skilled in the art that the gasoline base fuel may already contain some naphtha components. The concentration of the naphtha referred to above means the concentration of naphtha which is added into the liquid fuel composition as a blend with the gasoline base fuel and the octane booster compound, and does not include the concentration of any naphtha components already present in the gasoline base fuel.

In the liquid fuel compositions of the present invention, the gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives, in addition to the aromatic octane booster(s) mentioned above. The concentration and nature of the optional fuel additive(s) that may be included in the base gasoline or the gasoline composition of the present invention is not critical. Non-limiting examples of suitable types of fuel additives that can be included in the base gasoline or the gasoline composition of the present invention include antioxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline compositions herein may contain one or more organic sunscreen compounds and/or UV absorbers, such as those disclosed in European patent application no. 15169631.7, WO2015/059206 and WO2014/096250.

There is no particular limitation on the type of organic sunscreen/UV absorber compound(s) which can be used in the gasoline compositions of the present invention as long as it is suitable for use in a gasoline composition.

A wide variety of conventional organic sunscreen actives are suitable for use herein. Sagarin, et al., at Chapter VIII, pages 189 et seq., of Cosmetics Science and Technology (1972), discloses numerous suitable actives.

The gasoline compositions herein can also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$- to -$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or;

(A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

In the above, amounts (concentrations, % vol, ppmw, % wt) of components are of active matter, i.e. exclusive of volatile solvents/diluent materials.

The liquid fuel composition of the present invention can be produced by admixing the Fischer-Tropsch derived naphtha and the aromatic octane booster with a gasoline base fuel suitable for use in an internal combustion engine. Since the base fuel to which the GTL Naphtha and the essential fuel additive is admixed is a gasoline, then the liquid fuel composition produced is a gasoline composition.

The present invention will be further understood from the following examples. Unless otherwise stated, all amounts and concentrations disclosed in the examples are based on weight of the fully formulated fuel composition.

EXAMPLES

A number of fully formulated gasoline fuel compositions are prepared having the formulations shown in Table 1 below. All fuel compositions use the same base fuel. The base fuel is an unleaded gasoline fuel meeting the EN228 specification, containing no performance additive.

The RON, MON and aromatics content of the gasoline fuel compositions were measured using conventional test methods. The calculated aromatics content was also determined. Table 1 shows the results of these measurements.

TABLE 1

| Examples | Gasoline base fuel % vol | GTL Naphtha % vol | NMA % vol | MON (EN ISO5163) | RON (EN ISO5164) | Measured Aromatics % vol (EN ISO22854) | Calculated Aromatics % vol[1] | Delta (Calculated − Measured) % vol |
|---|---|---|---|---|---|---|---|---|
| 1* | 100 | 0 | 0 | 85.3 | 95.4 | 34.8 | — | — |
| 2* | 98.5 | 0 | 1.5 | 87.8 | 99.5 | 34.9 | 35.8 | 0.90 |
| 3 | 94.5 | 4.0 | 1.5 | 87.3 | 98.2 | 33.4 | 34.4 | 1.00 |
| 4* | 96.2 | 0 | 3.8 | 88.7 | 101.6 | 35.7 | 37.3 | 1.61 |
| 5 | 86.1 | 10.1 | 3.8 | 88.1 | 100.5 | 32.4 | 33.8 | 1.37 |

*Comparative Example

[1]Calculation uses Gasoline measured value of 34.8% vol; NMA = 100% aromatics; GTL Naphtha = 0% aromatics Discussion It can be seen from the Examples in Table 1 that gasoline can be upgraded to greater than 100 RON by addition of NMA while still complying with EN 228 gasoline specification requirements, in particular aromatics content.

As can be seen from Example 2 in Table 1, addition of 1.5% vol NMA only increases the RON value from 95.4 to 99.5, but this increases the aromatics content to 34.9% vol (measured) and 35.8% vol (calculated) which exceeds the EN 228 specification aromatics limit of 35% vol maximum. Further addition of NMA would be necessary to obtain a RON of greater than 100 and this would increase the aromatics content to well above the 35% vol EN 228 limit, e.g. Example 4 shows that addition of 3.8% vol NMA increases RON to 101.6 but aromatics are increased to 35.7% vol (measured) and 37.3% vol (calculated). As can be seen from Table 1, if GTL Naphtha is used as an additional blend component, this allows the 1.5% vol. level of NMA to obtain the required octane of RON 100 without exceeding the 35% vol aromatics EN 228 limit, e.g. Example 3 contains 4.0% vol. GTL Naphtha in addition to 1.5% vol. NMA and this has reduced the aromatics content compared to Example 2. Further addition of GTL Naphtha allows the NMA content to be increased to obtain greater than 100 RON and keep below the aromatics limit, e.g. Example 5 shows that use of 10.1% vol. GTL Naphtha in addition to the 3.8% vol. NMA increases RON to 100.5 and aromatics is actually reduced to 32.4% vol. (measured) and 33.8% vol. (calculated).

That which is claimed is:

1. Gasoline fuel composition suitable for use in an internal combustion engine comprising:

(a) Fischer-Tropsch derived naphtha at a level from 2 to 20% v/v, wherein the Fischer-Tropsch derived naphtha is a liquid hydrocarbon distillate with a final boiling point of up to 220° C. and an initial boiling point of at least 25° C. and which comprises at least 95% w/w of hydrocarbons having 5 or more carbon atoms and wherein the Fischer-Tropsch derived naphtha consists of at least 90% w/w of paraffinic components and has a Research Octane Number (RON), as measured by ASTM D2699, of at most 40;

(b) at least one aromatic octane booster present at a level of 0.75 to 8% v/v, wherein the aromatic octane booster is selected from aromatic amines, phenols, and mixtures thereof; and (c) a gasoline base fuel;

wherein the gasoline fuel composition comprises in the range from 32% v/v to 34% v/v of aromatics.

2. Gasoline fuel composition according to claim 1 wherein the aromatic octane booster is an aromatic amine.

3. Gasoline fuel composition according to claim 1 wherein the aromatic octane booster is N-methyl aniline.

4. Gasoline fuel composition according to claim 1 wherein the aromatic octane booster is present at a level of from 1% v/v to 6% v/v, based on the gasoline fuel composition.

5. Gasoline fuel composition according to claim 1 wherein the Fischer-Tropsch naphtha is present at a level from 3.5% v/v to 10.5% v/v, based on the gasoline fuel composition.

6. A method of increasing the Research Octane Number (RON) of a gasoline fuel composition in an internal combustion engine, said method comprising fueling the internal combustion engine with a gasoline fuel composition comprising:

(a) Fischer-Tropsch derived naphtha at a level from 2 to 20% v/v, wherein the Fischer-Tropsch derived naphtha is a liquid hydrocarbon distillate with a final boiling point of up to 220° C. and an initial boiling point of at least 25° C. and which comprises at least 95% w/w of hydrocarbons having 5 or more carbon atoms and wherein the Fischer-Tropsch derived naphtha consists of at least 90% w/w of paraffinic components and has a Research Octane Number (RON), as measured by ASTM D2699, of at most 40;

(b) at least one aromatic octane booster present at a level of 0.75 to 8% v/v, wherein the aromatic octane booster is selected from aromatic amines, phenols, and mixtures thereof; and (c) a gasoline base fuel;

wherein the gasoline fuel composition comprises in the range from 32% v/v to 34% v/v of aromatics.

7. Method according to claim 6 wherein the Research Octane Number (RON) of the gasoline fuel composition is increased by 1 unit or greater, while maintaining the aromatic content of the gasoline fuel composition at a level in the range from 32% v/v to 34% v/v, based on the gasoline fuel composition.

8. Method according to claim 6 wherein the aromatic octane booster is N-methyl aniline.

9. Method according to claim 6 wherein the aromatic octane booster is present at a level of from 1% v/v to 6% v/v, based on the gasoline fuel composition.

10. Method according to claim 6 wherein the Fischer-Tropsch naphtha is present at a level from 3.5% v/v to 10.5% v/v, based on the gasoline fuel composition.

* * * * *